US007515847B2

(12) United States Patent
Aramata

(10) Patent No.: US 7,515,847 B2
(45) Date of Patent: Apr. 7, 2009

(54) IMAGE FORMING APPARATUS WITH ADDITIONALLY INSTALLABLE APPARATUS HAVING A POSITIONING MEMBER

(75) Inventor: Sumio Aramata, Tokyo (JP)

(73) Assignee: Oki Data Corporation, Tokyo (JP)

( * ) Notice: Subject to any disclaimer, the term of this patent is extended or adjusted under 35 U.S.C. 154(b) by 172 days.

(21) Appl. No.: 11/281,569

(22) Filed: Nov. 17, 2005

(65) Prior Publication Data

US 2007/0212106 A1 Sep. 13, 2007

(30) Foreign Application Priority Data

Nov. 17, 2004 (JP) ..... 2004-332957

(51) Int. Cl.
*G03G 21/00* (2006.01)

(52) U.S. Cl. ..... 399/107

(58) Field of Classification Search ..... 399/107, 399/391, 110, 393

See application file for complete search history.

(56) References Cited

U.S. PATENT DOCUMENTS 4,841,330 A * 6/1989 Owada et al. ..... 399/119
5,678,148 A * 10/1997 Owada et al. ..... 399/279
2004/0264998 A1* 12/2004 Uchida ..... 399/107
2005/0100362 A1* 5/2005 Kim et al. ..... 399/107

FOREIGN PATENT DOCUMENTS

JP 08179607 A * 7/1996
JP 2001-225971 A 8/2001
JP 2006251215 A * 9/2006

* cited by examiner

*Primary Examiner*—Quana M Grainger
(74) *Attorney, Agent, or Firm*—Panitch Schwarze Belisario & Nadel LLP

(57) ABSTRACT

To provide an improvement capable of simplifying an operation for installing an additionally installable apparatus. An image forming apparatus comprises a apparatus main body 11 and at least one additionally installable apparatus, in which one additionally installable apparatus is detachably disposed to a main body side device composed at least of the apparatus main body 11. The additionally installable apparatus has a positioning member at a surface facing to the main body side device. The main body side device has a receiving portion configured to receive the positioning member at a surface facing to the additionally installable apparatus and a guiding member 22 for guiding the positioning member to the receiving portion. Due to an operation in which the apparatus main body 11 is held down for the purpose of establishing contact between the guide member 22 and the positioning member and a fine adjustment is made after establishing contact therebetween to cause the positioning member fit into the receiving portion, thereby achieving positioning of the additionally installable apparatus, high positioning accuracy during the initial operation is not required.

20 Claims, 10 Drawing Sheets

IMAGE FORMING APPARATUS WITH ADDITIONALLY INSTALLABLE APPARATUS HAVING A POSITIONING MEMBER

BACKGROUND OF THE INVENTION

1. Field of the Invention

This invention relates to an image forming apparatus and an additionally installable apparatus.

2. Description of Related Art

In conventional image forming apparatuses such as a printer, a photocopier, a facsimile machine, and the like, for example, the printer can be installed with at least one additionally installable feeding tray in such a manner that the additionally installable feeding tray is detachably disposed to a lower side of a main body of the printer (see, e.g., Japanese Patent Application Publication No. 2001-225,971).

Upon installment of the additionally installable feeding tray, an additionally installable feeding tray to be newly installed can be positioned so that the printer does not fall down and that papers can be fed stably to, e.g., the main body or the additionally installable feeding tray which is already installed on an upper level.

FIG. 2 is an exploded perspective view of the conventional printer.

In FIG. 2, numeral 50 is a printer, numeral 51 is an apparatus main body, and numerals 52, 53 are additionally installable feeding trays. The apparatus main body 51 constitutes a main body side device while the additionally installable feeding tray 52 constitutes the additionally installable apparatus in a case of installment of the additionally installable feeding tray 52. The apparatus main body 51 and the additionally installable feeding tray 52, on the other hand, constitute the main body side device while the additionally installable feeding tray 53 constitutes the additionally installable apparatus in a case of installment of the additionally installable feeding tray 53.

A positioning post 55 is formed as projecting upward at a predetermined portion on an upper surface of respective exterior covers of the respective additionally installable feeding trays 52, 53 whereas a positioning hole 57 is formed at a position corresponding to the positioning post 55, at a lower surface of the respective exterior covers of the apparatus main body 51 and the additionally installable feeding trays 52, 53.

Therefore, the additionally installable feeding tray 52 can be positioned with respect to the apparatus main body 51 and combined therewith upon fitting the positioning post 55 into the positioning hole 57, so that the additionally installable feeding tray 53 can be positioned with respect to the apparatus main body 51 and the additionally installable feeding tray 52 and combined therewith.

With the above described conventional printer, however, the position of the positioning post 55 cannot be viewed upon installment of the additionally installable feeding trays 52, 53 since the positioning post 55 is hidden behind the apparatus main body 51 and the additionally installable feeding tray 52, thereby making installation operation difficult.

An object of this invention is to solve the above problems in the conventional printer and to provide an image forming apparatus and an additionally installable apparatus capable of simplifying the installment operation of the additionally installable apparatus.

SUMMARY OF THE INVENTION

To achieve the above object, an image forming apparatus according to this invention comprises an apparatus main body and at least one additionally installable apparatus, and the single additionally installable apparatus is detachably disposed to a main body side device composed at least of the apparatus main body.

The additionally installable apparatus comprises a positioning member at a surface facing to the main body side device. Furthermore, the main body side device comprises a receiving portion for receiving the positioning member at a surface facing to the additionally installable apparatus and a guiding member for guiding the positioning member to the receiving portion.

The image forming apparatus according to this invention comprises the apparatus main body and at least one additionally installable apparatus, and the single additionally installable apparatus is detachably disposed to the main body side device composed at least of the apparatus main body.

The additionally installable apparatus comprises the positioning member at the surface facing to the main body side device. Furthermore, the main body side device comprises the receiving portion for receiving the positioning member at the surface facing to the additionally installable apparatus and the guiding member for guiding the positioning member to the receiving portion.

In this case, it is not necessary to improve positional accuracy during initial phase of the installation operation since the additionally installable apparatus can be positioned upon fitting the positioning member into the receiving portion according to fine adjustment which is made after the guiding member and the positioning member is brought in contact upon holding down the apparatus main body with a goal of contact between the guiding member and the positioning member. The installment operation of the additionally installable apparatus can therefore be simplified.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

DETAILED DESCRIPTION OF PREFERRED EMBODIMENTS OF THE INVENTION

Hereinafter, embodiments of this invention will be explained in detail in reference to drawings. In this case, a multicolor printer is explained as an example of image forming apparatuses.

Figure 3:
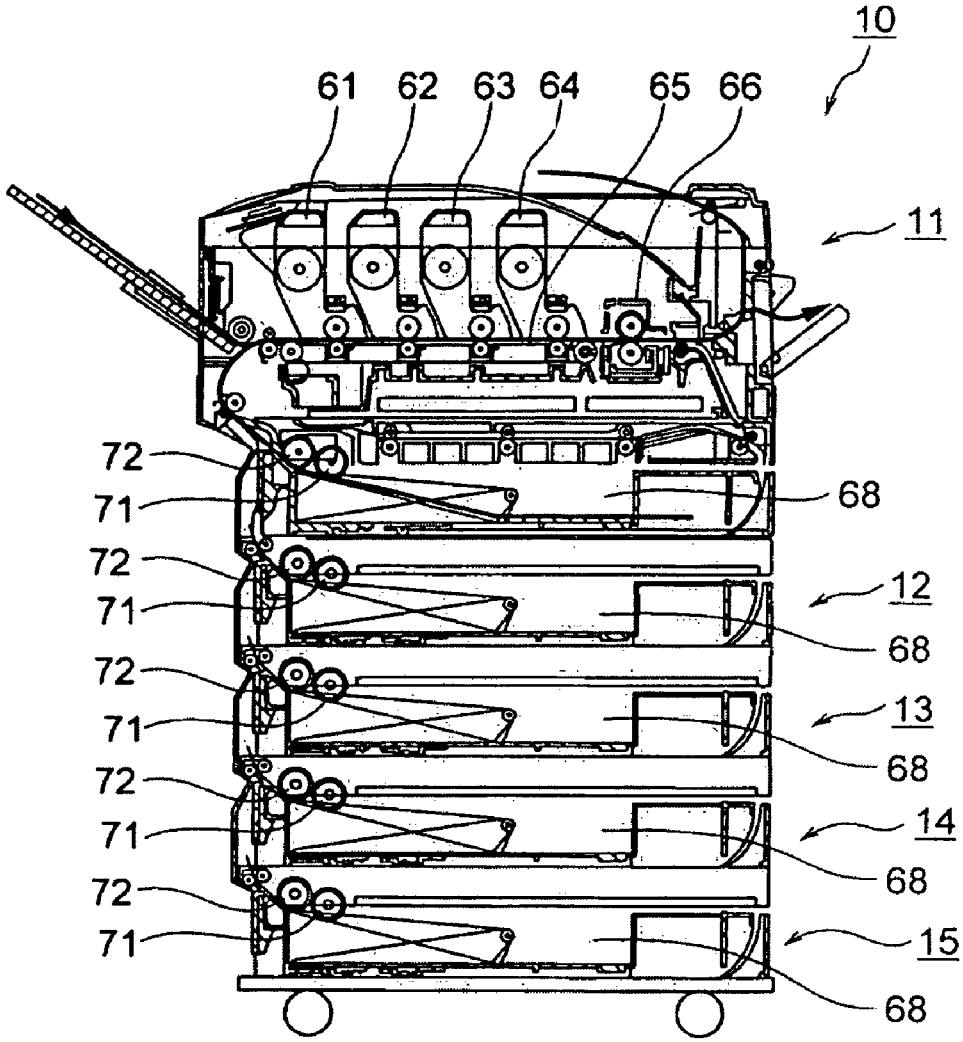
FIG. 3 is a schematic view of an image forming apparatus according to embodiments of this invention.
Figure 4:
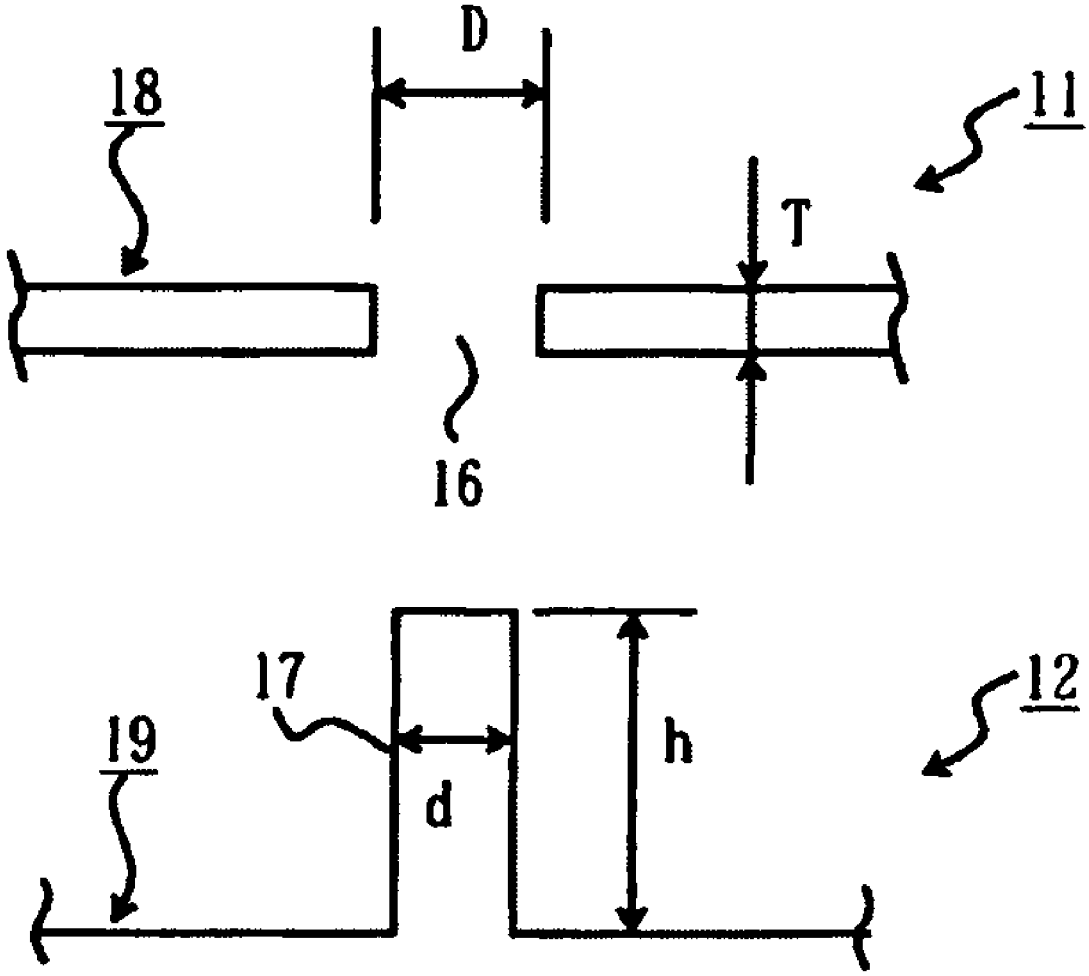
FIG. 4 is a conceptual view of a positioning mechanism according to the first embodiment of this invention.

FIG. 3 is a schematic view of an image forming apparatus according to embodiments of this invention. FIG. 4 is a conceptual view of a positioning mechanism according to the first embodiment of this invention.

In FIG. 3 and FIG. 4, numeral 10 is a printer, numeral 11 is an apparatus main body, and numerals 12, 13, 14, 15 are additionally installable feeding trays. When attempting to install the additionally installable feeding tray 12, the apparatus main body 11 constitutes a main body side device, whereas the additionally installable feeding tray 12 constitutes an additionally installable apparatus. When attempting to install the additionally installable feeding tray 13, the apparatus main body 11 and the additionally installable feeding tray 12 constitute the main body side device while the additionally installable feeding tray 13 constitutes the additionally installable apparatus. When attempting to install the additionally installable feeding tray 14, the apparatus main body 11 and the additionally installable feeding trays 12, 13 constitute main body side device while the additionally installable feeding tray 14 constitutes the additionally installable apparatus. When attempting to install the additionally installable feeding tray 15, the apparatus main body 11 and the additionally installable feeding trays 12, 13, 14 constitute the main body side device while the additionally installable feeding tray 15 constitutes the additionally installable apparatus.

The apparatus main body 11 has image forming units 61, 62, 63, 64 in respective colors of yellow, magenta, cyan, and black, a transfer unit 65 for forming a multicolored toner image upon transferring onto a paper serving as medium toner images in each color serving as a developer image formed by each of the image forming units 61, 62, 63, 64, a fusing device 66 for fusing the multicolored toner image onto the paper, a paper cassette 68 serving as a medium container for containing papers, a feeding roller 71 serving as a supplying roller for picking up a paper from the paper cassette 68 to send the paper through a gap between each of the image forming units 61, 62, 63, 64, and the transfer unit 65, and a separating frame 72 serving as a separating member for separating each paper sheet by sheet, or the like. Furthermore, the paper cassette 68, the feeding roller 71, and the separating frame 72 are disposed at each of the additionally installable feeding trays 12, 13, 14, 15.

With the printer 10 thus structured, the papers are fed from the paper cassette 68 upon separated sheet by sheet with the feeding roller 71 and the separating frame 72 and conveyed with the transfer unit 65 to be sent to each of the image forming units 61, 62, 63, 64, so that the toner images in respective colors formed by the image forming units 61, 62, 63, 64, are transferred in piles, thereby forming the multicolored toner image.

The paper is subsequently sent to the fusing device 66 to fuse the multicolored toner image at the fusing device 66, and then the paper is discharged from the printer 10. The multicolored images are thus formed.

An operator holds up the apparatus main body 11 by gripping a handle formed at an exterior cover of the apparatus main body 11 when installing the additionally installable feeding tray 12 to the printer 10 thus structured. Positioning operation is made upon fitting a positioning post 17 serving as a positioning member formed at such a surface of the exterior cover of the additionally installable feeding tray 12 as facing to the apparatus main body 11, or namely at an upper surface 19 into a positioning hole 16 serving as a receiving portion formed at such a surface of the exterior cover of the apparatus main body 11 as facing to the additionally installable feeding tray 12, or namely at a bottom surface 18. The additionally feeding tray 12 can thus be mounted to the apparatus main body 11.

Furthermore, the handle is formed at the exterior cover of each of the additionally installable feeding trays 12, 13, 14, 15 as well. Therefore, the positioning operation is made in a manner that the operator holds up the main body side device by gripping the handle of the additionally installable feeding tray which is already mounted to the apparatus main body 11 to fit the positioning post formed at the upper surface of the exterior cover of the additionally installable feeding tray which is newly to be additionally installed, into the positioning hole, not shown, formed at the bottom surface of the exterior cover of the additionally installable feeding tray. The additionally installable feeding trays 12, 13, 14, 15 can be thus disposed in a multi-tiered manner.

As shown in FIG. 4, the positioning hole 16 is formed at a predetermined position of the bottom surface 18 with thickness T in a manner to have inner diameter D to receive the positioning post 17. Furthermore, the positioning post 17 is formed at a predetermined position of the upper surface 19 in a manner to have outer diameter d and height h.

A guiding member for guiding the positioning post 17 to the positioning hole 16 is described next.

Figure 1:
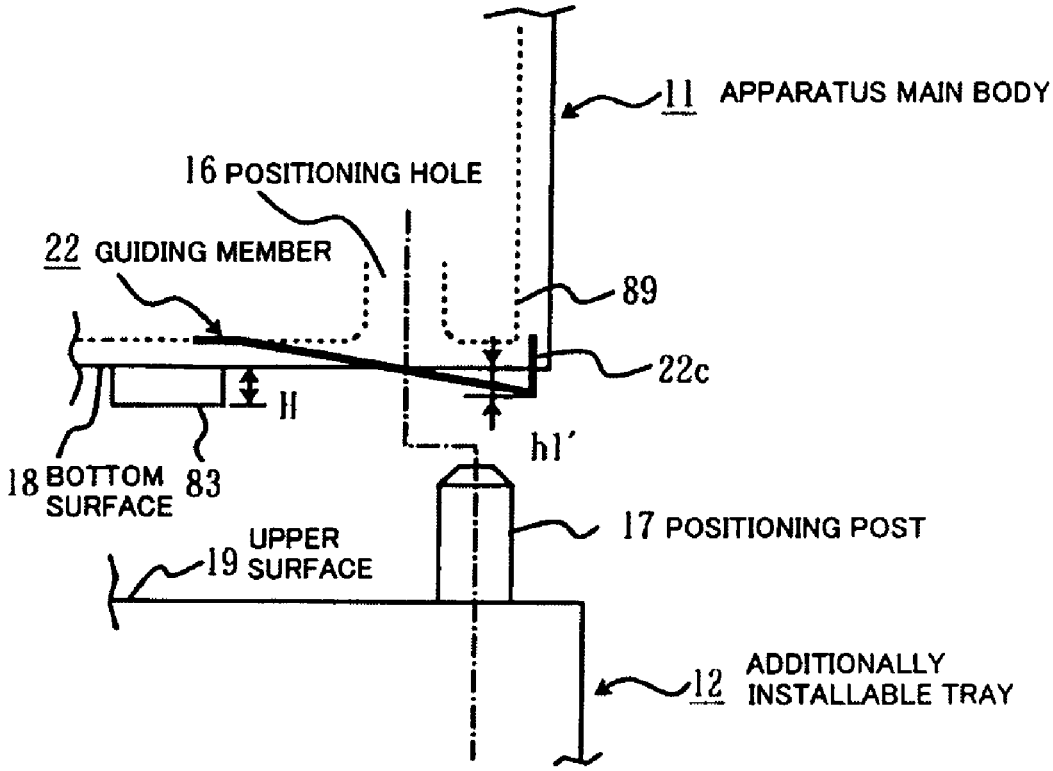
FIG. 1 is a view showing a method of attaching and detaching an additionally installable feeding tray with respect to an apparatus main body according to a first embodiment of this invention.
Figure 2:
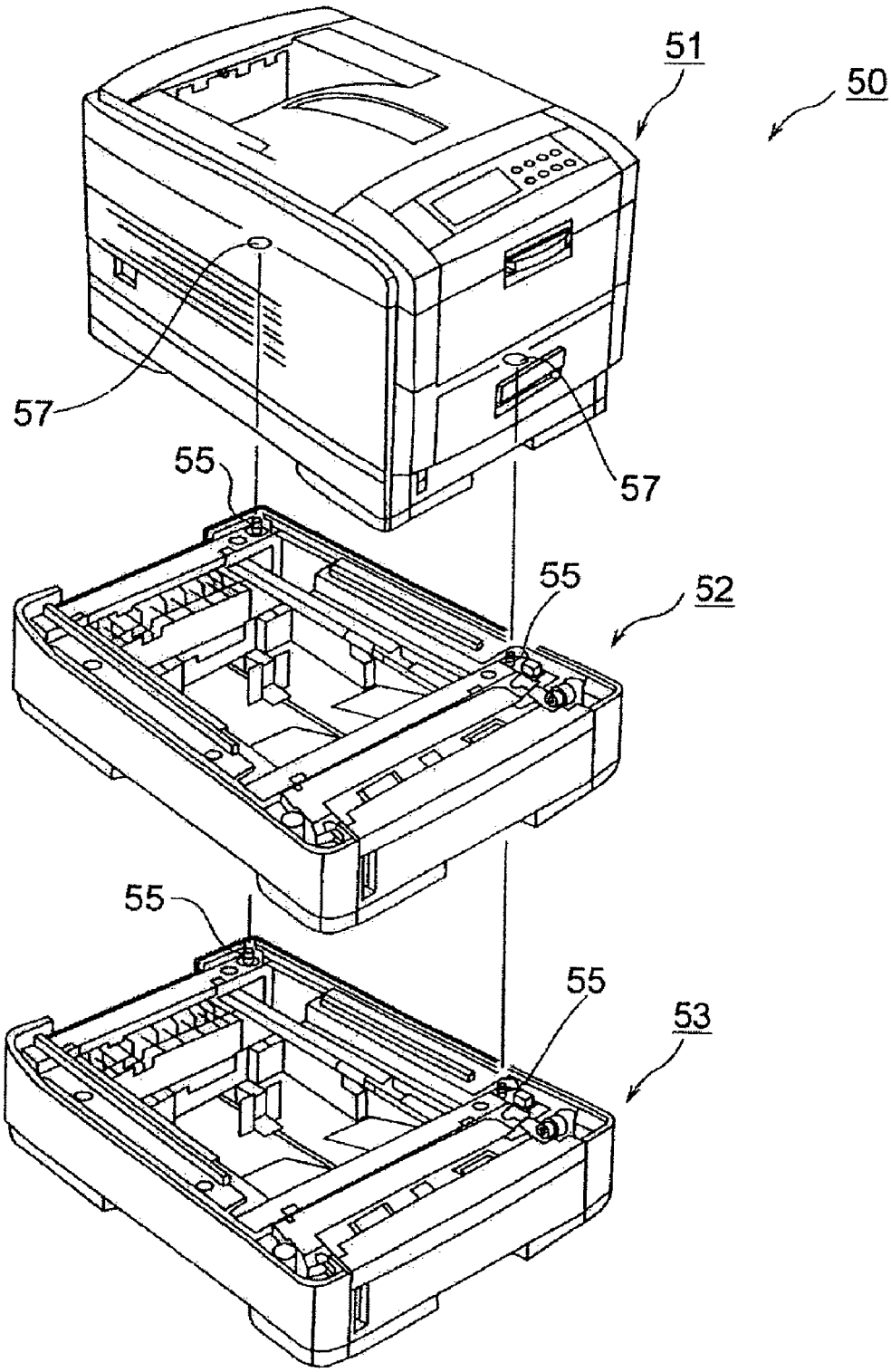
FIG. 2 PRIOR ART
FIG. 2 is an exploded perspective view of a conventional printer.
Figure 5:
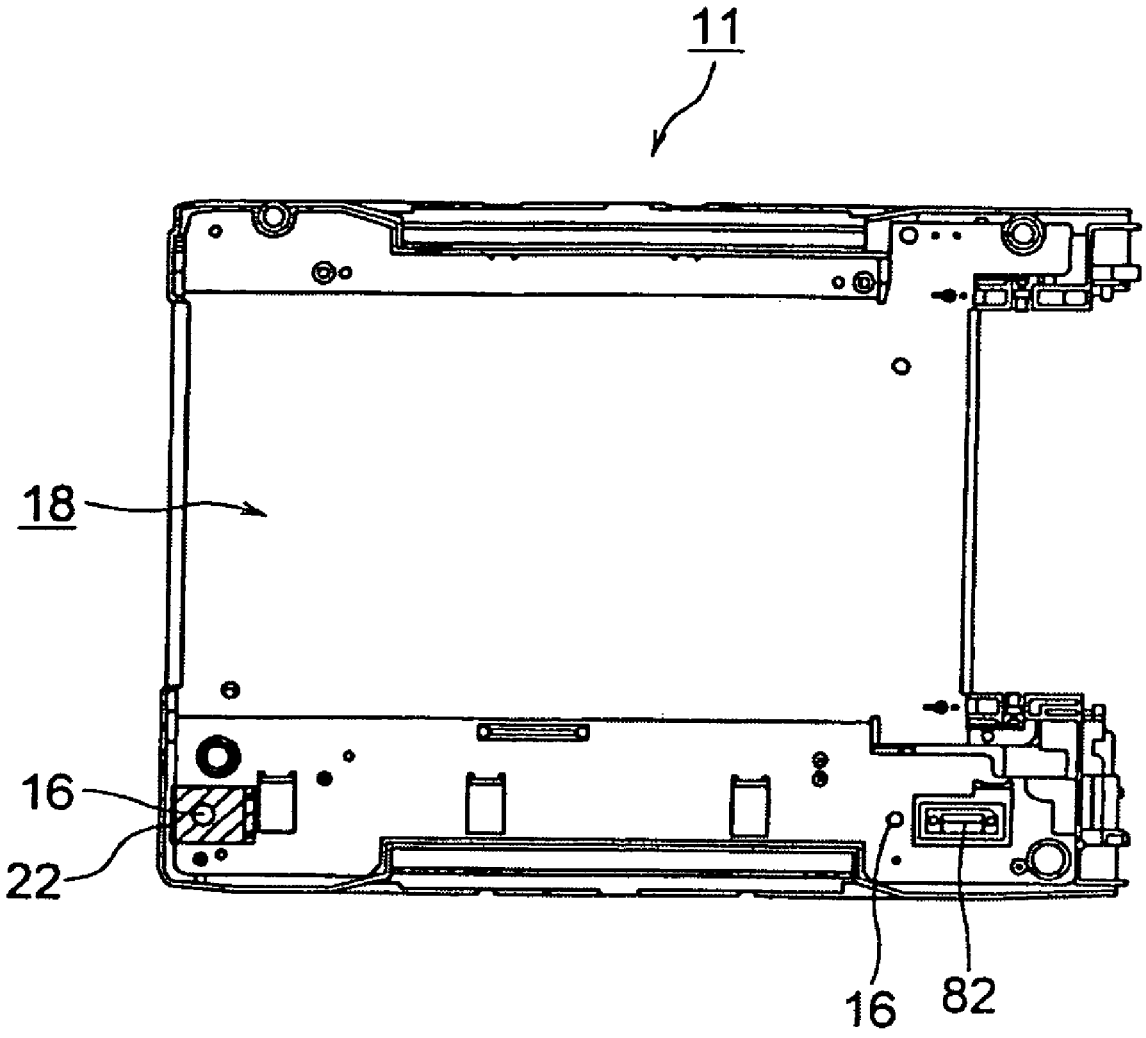
FIG. 5 is a view showing a bottom surface of the apparatus main body according to the first embodiment of this invention.
Figure 6:
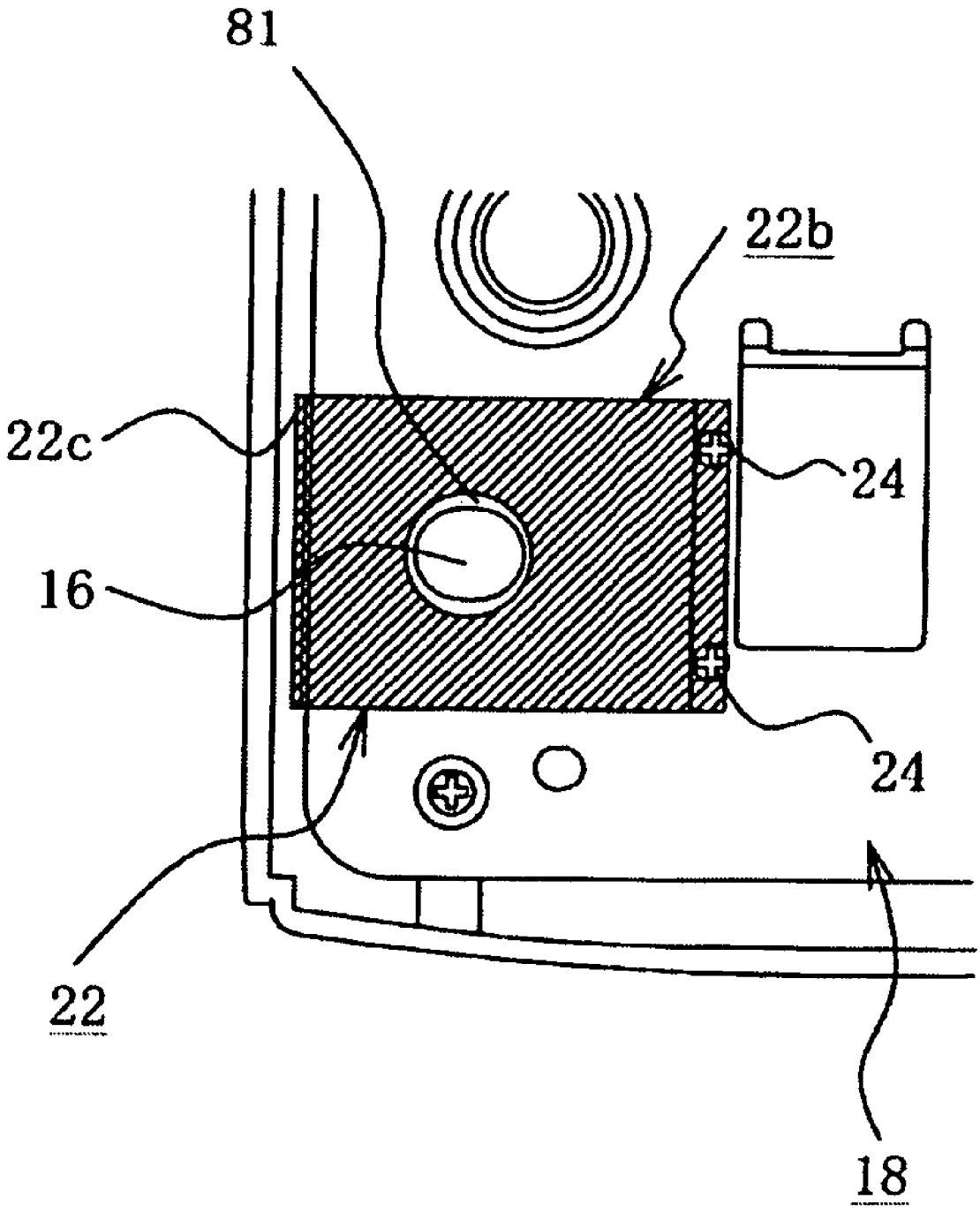
FIG. 6 is an enlarged view showing an essential part of the bottom surface of the apparatus main body according to the first embodiment of this invention.
Figure 7:
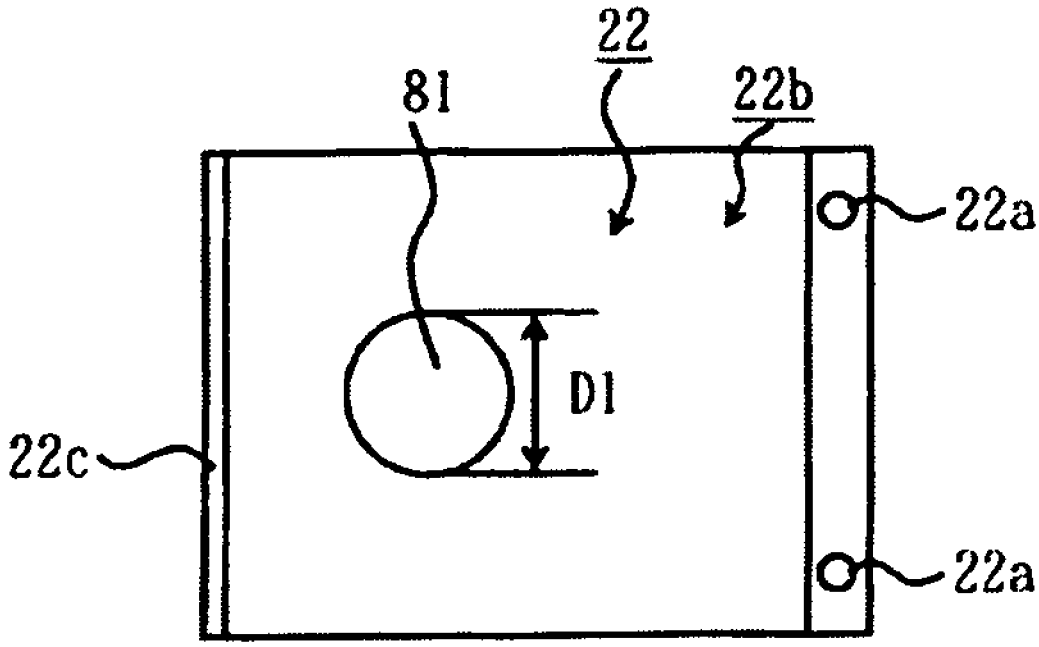
FIG. 7 is a plan view of a guiding member according to the first embodiment of this invention.
Figure 8:
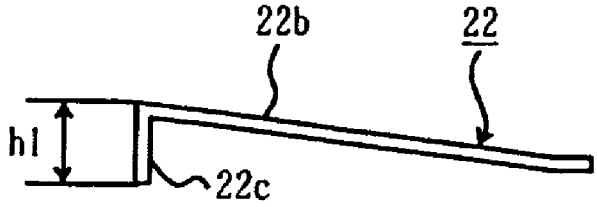
FIG. 8 is a side view of the guiding member according to the first embodiment of this invention.

FIG. 1 is a view showing a method of attaching and detaching the additionally installable feeding tray with respect to the apparatus main body according to the first embodiment of this invention. FIG. 5 is a view showing the bottom surface of the apparatus main body according to the first embodiment of this invention. FIG. 6 is an enlarged view showing an essential part of the bottom surface of the apparatus main body according to the first embodiment of this invention. FIG. 7 is a plan view of a guiding member according to the first embodiment of this invention. FIG. 8 is a side view of the guiding member according to the first embodiment of this invention.

In drawings, numeral 16 is the positioning hole, and numeral 22 is a guiding member, and numeral 82 is a connector for electrically connecting the apparatus main body 11 to the additionally installable feeding tray 12. The guiding member 22 is mounted to the bottom surface 18 of the apparatus main body 11 with a screw 24 serving as a mounting member. A screw hole 22*a* is therefore formed at one end of the guiding member 22. To guide the positioning post 17 to the positioning hole 16, the guiding member 22 has a guiding portion 22*b* formed as inclined in a manner to have a higher level as extending from the vicinity of the screw hole 22*a* to the other end and an upright portion 22*c* formed at the other end, as having height h1 in a direction perpendicular to the bottom surface 18, and furthermore, a guiding hole 81 for allowing the positioning post 17 to pass therethrough is formed corresponding to the positioning hole 16, at the guiding portion 22*b*.

Furthermore, a slit 89 serving as a container for containing the upright portion 22*c* is formed as facing to the upright portion 22*c* and as open at the bottom surface 18 of the apparatus main body 11.

The guiding hole 81 has inner diameter D1 greater than the inner diameter D of the positioning hole 16, and the inner diameter D1 is set to satisfy the inequality, $d<D<D1$. Furthermore, clearance δ indicated by difference between the inner diameter D of the positioning hole 16 and the outer diameter d of the positioning post 17 satisfies expression $\delta=D-d$, and is set to satisfy the inequality, $0.1 \leqq \delta \leqq 0.2$ [mm], for improvement of positional accuracy.

In a case where the plurality of positioning holes 16 are formed, the guiding member 22 is mounted to one of those positioning holes 16 but is desirably kept away from the positioning hole 16 near which the connector 82 is disposed so as to be mounted to the positioning hole 16 distant from the connector 82 in this case.

That is, there is a risk of damaging the connector 82 where the positioning hole 16 and the positioning post 17 cannot be fit on the condition that the connector 82 is located near the guiding member 22 at a time of making the positioning operation between the apparatus main body 11 and the additionally installable feeding tray 12 in using the guiding member 22. Furthermore, where the connector 82 is located near the guiding member 22 at a time of making the positioning operation between the apparatus main body 11 and the additionally installable feeding tray 12 in using the guiding member 22, it is necessary to fit the positioning post 17 into the positioning hole 16 located at a position distant from the connector 82 upon moving the apparatus main body 11 after the connector 82 connects to or comes in contact with the apparatus main body 11. It becomes difficult in this case to move the apparatus main body 11 in such a status as connected to or brought in contact with the connector 82, and the connector 82 may be damaged where the apparatus main body 11 is moved forcedly.

Consequently, the positioning post 17 is desirably fit into the positioning hole 16 near the connector 82 after inserting the positioning post 17 into the positioning hole 16 at the position distant from the connector 82.

It is to be noted that the guiding member 22 is formed of a plate made of a material having elasticity such as a phosphor bronze plate, e.g., C5210P, or namely a leaf spring and that the upright portion 22*c* is formed upon folding the above plate. Furthermore, the bottom surface 18 of the apparatus main body 11 is formed of a metal plate having electrical conductivity such as, e.g., electrogalvanized steel sheet (SECC) and connected to an earth cable via a power supply unit. Therefore, the guiding member 22 is connected electrically to the apparatus main body 11 when the additionally installable feeding tray 12 is mounted to the apparatus main body 11.

In the meanwhile, the operator holds up the apparatus main body 11 by gripping the handle formed at the exterior cover of the apparatus main body 11 to stack the apparatus main body 11 on the additionally installable feeding tray 12 when mounting the additionally installable feeding tray 12 to the apparatus main body 11. In this bout, the operator first holds down the apparatus main body 11 while putting the exterior cover of the apparatus main body 11 together with the exterior cover of the additionally installable feeding tray 12 so that the guiding member 22 and the positioning post 17 come in contact with each other. In a case of making the positioning operation without any trouble, the positioning post 17 is brought in contact with the guiding member 22, so that the operator can confirm that the positioning operation results in success within a certain range, i.e., a range of a width or depth of the guiding member 22, as the guiding member 22 is located at a bent position.

The guiding member 22 is subsequently pushed toward the bottom surface 18 of the apparatus main body 11 with the positioning post 17 to be pressed against the bottom surface 18 when the operator holds down the apparatus main body 11 furthermore. At this time, the upright portion 22*c* penetrates into the slit 89. The operator moves the apparatus main body 11 within a certain range to adjust positioning between the positioning post 17 and the guiding hole 81. As such, the guiding hole 81 functions as a guide, so that the positioning post 17 penetrating into the guiding hole 81 fits into the positioning hole 16. The guiding member 22 is then released from pressing force from the positioning post 17 and bent back upon self elastic force, thereby being brought in contact with the upper surface 19 of the additionally installable feeding tray 12 at a bent-back position.

In the meanwhile, in a case of the plurality of positioning holes 16, a position of the apparatus main body 11 is adjusted upon defining the positioning post 17 which is previously fit into the positioning hole 16 as an axis, and then the rest of the positioning posts 17 are sequentially fit into the positioning holes 16.

As described above, it is not necessary to improve the positional accuracy during initial phase of the operation since the additionally installable feeding tray 12 can be positioned upon fitting the positioning post 17 into the positioning hole 16 according to fine adjustment which is made after the guiding member 22 and the positioning post 17 are brought in contact with each other upon holding down the apparatus main body 11 with a goal of contact between the guiding member 22 and the positioning post 17. Consequently, the additional installment operation of the additionally installable feeding tray 12 can be simplified.

In the meanwhile, the guiding member 22 is not moved if the positioning post 17 is fit into the positioning hole 16 without pushing the guiding member 22 with the positioning post 17 but the operator can confirm according to a feel at a time of his fitting operation, that the positioning operation results in success.

Furthermore, the guiding member 22 has the electric conductivity as described above, thereby having function of electrically connecting the apparatus main body 11 to the additionally installable feeding tray 12 and function as a ground member. Thus, upon occurrence of overcurrent at the additionally installable feeding tray 12, the overcurrent is carried in order of the guiding member 22, the bottom surface 18 of the apparatus main body 11, the power supply unit of the apparatus main body 11, and the earth cable of a power cable, thereby being discharged. In the meanwhile, the guiding member 22 is set to have height h1' shorter than height H of an installation leg 83 of the apparatus main body 11 at a time of being installed to the apparatus main body 11 so the apparatus main body 11 as not to be connected to a ground of an installation surface where using the apparatus main body 11 alone without installing the additionally installable feeding tray 12.

The guiding member 22 furthermore has function of electrically connecting the apparatus main body 11 to the additionally installable feeding tray 12, thereby not requiring arrangement of an electrically jointing member to the additionally installable feeding tray 12, so that a cost of the additionally installable feeding tray 12 can be lowered.

The operator can view guiding member 22 from an exterior until when making the positioning hole 16 and the positioning post 17 in contact with each other but cannot view the guiding member 22 during the subsequent operation, thereby not being able to confirm a mounting condition of the guiding member 22.

Herein, the second embodiment is described, in which the condition of the guiding member 22 can be confirmed. It is to be noted that the substantially same structures as those of the first embodiment are assigned with the same reference numbers respectively so that those duplicated descriptions are omitted for the sake of simplicity.

Figure 9:
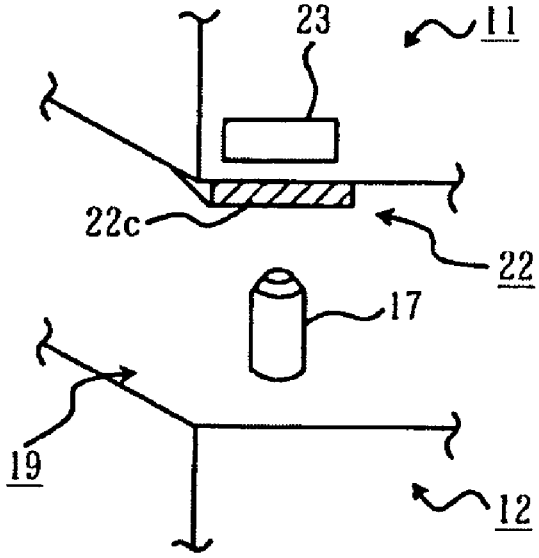
FIG. 9 is a first view showing a mounting condition of an additionally installable feeding tray according to a second embodiment of this invention.
Figure 10:
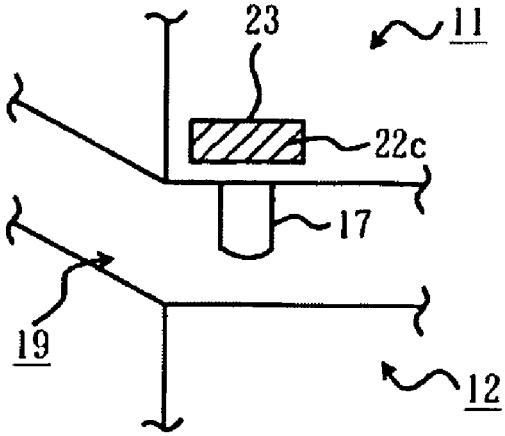
FIG. 10 is a second view showing the mounting condition of the additionally installable feeding tray according to the second embodiment of this invention.
Figure 11:
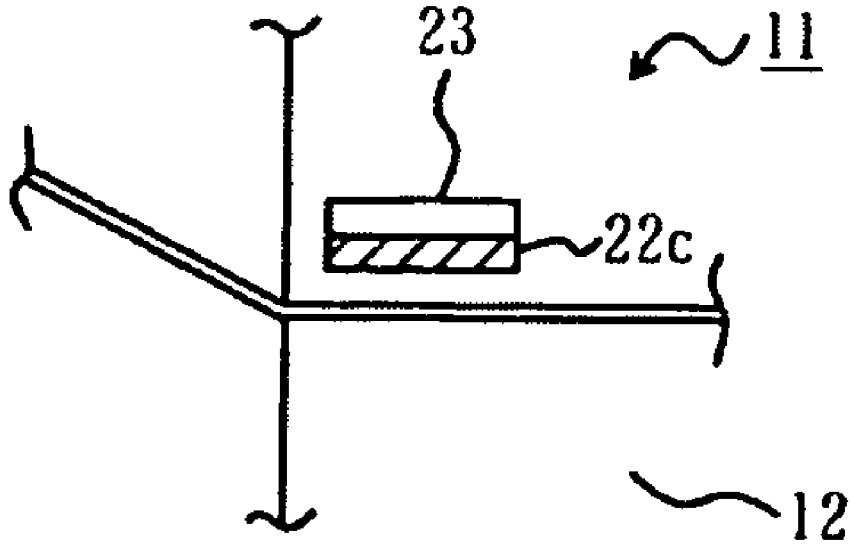
FIG. 11 is a third view showing the mounting condition of the additionally installable feeding tray according to the second embodiment of this invention.
Figure 12:
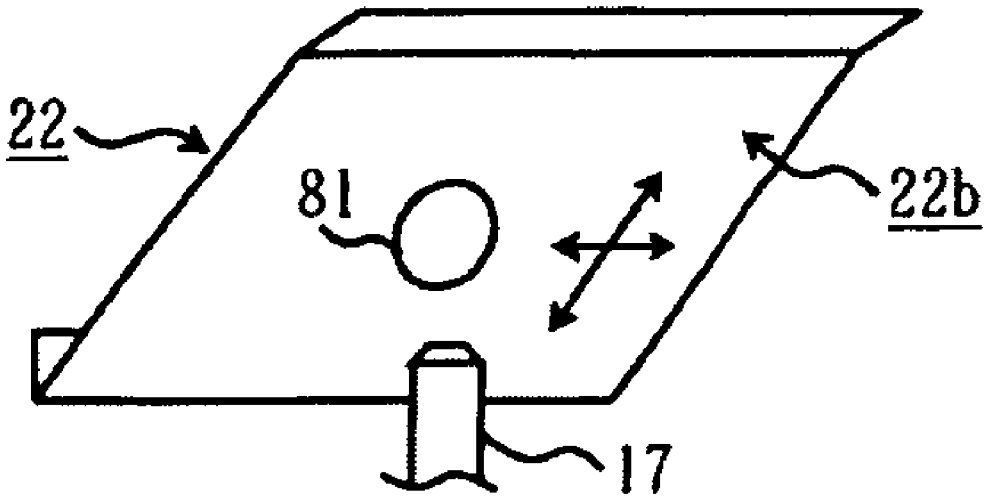
FIG. 12 is a view showing a status where a guiding hole is located according to the second embodiment of this invention.

FIG. 9 is a first view showing the mounting condition of an additionally installable feeding tray according to the second embodiment of this invention. FIG. 10 is a second view showing the mounting condition of the additionally installable feeding tray according to the second embodiment of this invention. FIG. 11 is a third view showing the mounting condition of the additionally installable feeding tray according to the second embodiment of this invention. FIG. 12 is a view showing a status where a guiding hole is located according to the second embodiment of this invention.

In this case, the slit 89 shown in FIG. 1 is formed at an inner side of the exterior cover of the apparatus main body 11 so that the guiding member 22 can be moved at the inner side of the exterior cover. Furthermore, a confirmation window 23 for confirming the mounting condition of the guiding member 22 is formed at the exterior cover. Therefore, if the guiding member 22 is pushed with the positioning post 17 serving as the positioning member, the operator can visually confirm the mounting condition of the guiding member 22 from the exterior at a predetermined position of the guiding member 22, i.e., at the ratio of the upright portion 22*c* to the confirmation window 23 as shown in FIG. 9 and FIG. 10 in this embodiment since the upright portion 22*c* is moved along the confirmation window 23. At this time, the upright portion 22*c* functions as a mounting condition indicator for indicating the mounting condition of the guiding member 22. Furthermore, a part of the upright portion 22*c* can be viewed through the confirmation window 23 as shown in FIG. 11 since the guiding member 22 is brought in contact with the upper surface 19 of the additionally installable feeding tray 12 when the positioning post 17 is fit into the positioning hole 16 as a receiving portion as described above. Therefore, the operator can confirm easily that the positioning operation results in success.

On the other hand, the guiding member 22 remains in contact with the bottom surface 18 of the apparatus main body 11, thereby not coming in contact with the upper surface 19 if the positioning post 17 does not fit into the positioning hole 16. In this case, the entire upright portion 22*c* can be viewed through the confirmation window 23 as shown in FIG. 10. The operator thus can confirm easily that the positioning operation results in failure.

It is possible to describe how the upright portion 22*c* can be viewed at a time of the successful positioning operation to the exterior cover around the confirmation window 23.

As described above, the confirmation window 23 is formed in this embodiment, so that the mounting condition of the additionally installable feeding tray 12 can be visually confirmed during and after assembly operation, thereby being able to improve workability furthermore.

In the meanwhile, since the guiding member 22 is in a flat plate shape, the operator has to locate the guiding hole 81 by moving the apparatus main body 11 from front to back and from side to side to make the fine adjustment after bringing the guiding member 22 and the positioning post 17 into contact, thereby being not able to simplify the operation sufficiently.

That is, it is necessary to locate the guiding hole 81 upon moving the positional post 17 in an arrow direction as shown in FIG. 12.

Herein, the third embodiment is described, in which the guiding hole 81 can be located easily enough to simplify the operation sufficiently. It is to be noted that the substantially same structures as those of the first embodiment are assigned with the same reference numbers respectively so that those duplicated descriptions are omitted for the sake of simplicity.

Figure 13:
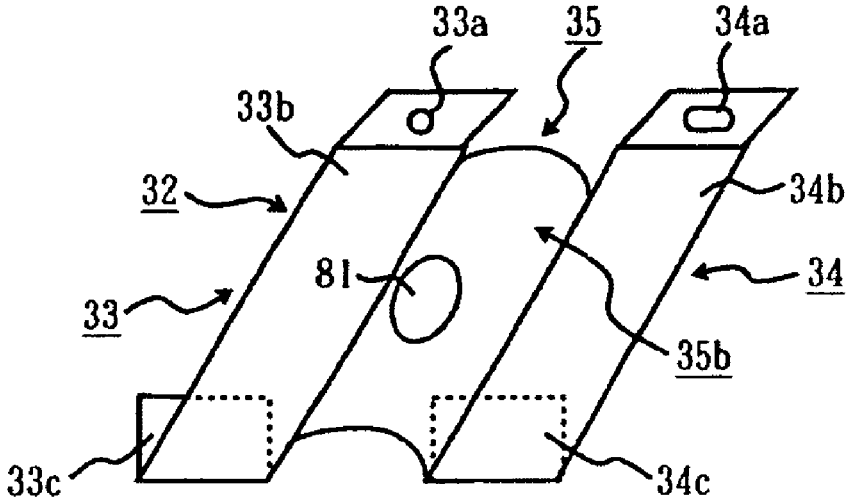
FIG. 13 is a perspective view of a guiding member according to a third embodiment of this invention.
Figure 14:
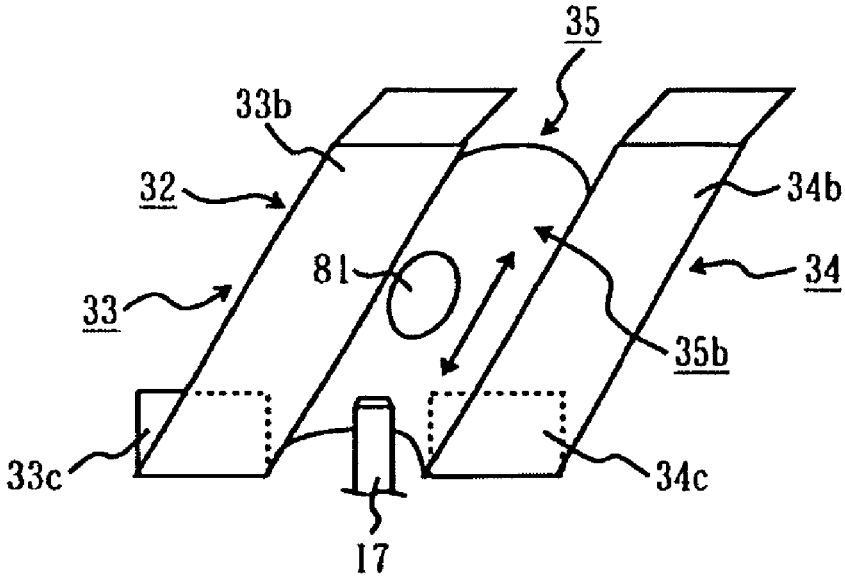
FIG. 14 is a view showing a status where a guiding hole is located according to the third embodiment of this invention.

FIG. 13 is a perspective view of a guiding member according to a third embodiment of this invention. FIG. 14 is a view showing a status where a guiding hole is located according to the third embodiment of this invention.

In drawings, numeral 32 is a guiding member, and the guiding member 32 has two flat plate bases 33, 34 in a flat plate form, disposed in parallel and a groove portion 35 in such a curved form as forming a concave surface facing downward, disposed between the flat plate bases 33, 34. Each of screw holes 33*a*, 34*a* is formed at each of the flat plate bases 33, 34 at one end of the guiding member 32. To guide the positioning post 17 to the positioning hole 16 shown in FIG. 1, the guiding member 32 has guiding portions 33*b*, 34*b*, 35*b* formed as inclined in a manner to have a higher level as extending from the vicinity of the screw holes 33*a*, 34*a* to the other end and upright portions 33*c*, 34*c* having the height h1 in a direction perpendicular to the bottom surface 18, and furthermore the guiding hole 81 for allowing the positioning hole 17 to pass therethrough is formed corresponding to the positioning hole 16, at the guiding portion 35*b*.

The operator holds up the apparatus main body 11 by gripping the handle formed at the exterior cover of the apparatus main body 11 to stack the apparatus main body 11 on the additionally installable feeding tray 12 when mounting the apparatus main body 11 onto the additionally installable feeding tray 12. In this bout, the operator first holds down the apparatus main body 11 while putting the exterior cover of the apparatus main body 11 together with the exterior cover of the additionally installable feeding tray 12, so that the guiding member 32 and the positioning post 17 come in contact with each other. The operator can confirm that the positioning operation results in success within a certain range, i.e., a range of a width or depth of the guiding member 32 since the positioning post 17 comes in contact with the guiding member 32 in a case of the successful positioning operation.

The guiding member 32 is pushed toward the bottom surface 18 of the apparatus main body 11 with the positioning post 17, thereby being pressed against the bottom surface 18 when the operator holds down the apparatus main body 11 furthermore. At this time, the upright portions 33*c*, 34*c* penetrate into the slit 89. The operator subsequently restricts right and left movement of the apparatus main body 11 where inserting the positioning post 17 into the groove portion 35 by moving the apparatus main body 11 in right and left directions.

The guiding hole 81 then functions as a guide when the operator moves the apparatus main body 11 from front to back to put the positioning post 17 into the guiding hole 81, so that the positioning post 17 inserting into the guiding hole 81 fits into the positioning hole 16.

In the meanwhile, the guiding member 32 is deformed when brought in contact and pressed with the positioning post 17 but deformation of the guiding hole 81 in association with the deformation of the guiding member 32 is limited within an allowable range since the guiding hole 81 is in an elongate hole shape. The guiding member 32 restores to an original state after completion of the positioning operation.

In this embodiment, the groove portion 35 is formed at the guiding member 32 to guide the apparatus main body 11 in this embodiment, thereby being able to improve the workability furthermore.

In this invention, the printer 10 is described as the image forming apparatuses but this invention can be applied to the image forming apparatus, e.g., such a photocopier, a facsimile machine, a printing apparatus, or the like, as allowing a bottom surface of an apparatus main body to be installed with other additionally installable apparatuses such as, e.g., the additionally installable feeding tray capable of being disposed in a multi-tiered manner. In the meanwhile, other than the additionally installable feeding tray, a double sided unit is defined as the additionally installable apparatus.

It is to be noted that his invention is not limited to the above described embodiments but can be variously modified based on the purpose of this invention, and those modifications are not excluded from the scope of this invention.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. An image forming apparatus comprising:

a main body having an image forming section; and an additionally installable apparatus detachably attached to said main body, the additionally installable apparatus having a positioning member on a surface facing to said main body;

wherein said main body has a receiving portion disposed on a surface facing to said additionally installable apparatus for receiving said positioning member, a movable guide member for guiding said positioning member to said receiving portion, and a confirmation window through which a portion of the guide member can be seen, wherein when the positioning member pushes the guide member, a movement of the portion of the guide member can be seen through the confirmation window.

2. The image forming apparatus according to claim 1, wherein said guide member is flexible.

3. The image forming apparatus according to claim 1, wherein said guide member has a groove portion for guiding said positioning member.

4. The image forming apparatus according to claim 1, wherein said guide member is a leaf spring shifting to a bent position when said positioning member does not yet fit to said receiving portion and returning to a bent-back position when said positioning member fits to said receiving portion.

5. The image forming apparatus according to claim 1, wherein said guide member is electrically conductive.

6. The image forming apparatus according to claim 1, wherein said guide member is made of phosphor bronze.

7. An image forming apparatus comprising:

a main body having an image forming section; and an additionally installable apparatus detachably attached to said main body, the additionally installable apparatus having a positioning member on a surface facing to said main body;

wherein said main body has a receiving portion disposed on a surface facing to said additionally installable apparatus for receiving said positioning member, a mounting condition indicator arranged near said receiving portion and movable in a direction in which said additionally installable apparatus moves to attach to and detach from said main body and a confirmation window that allows a user to see a location of said mounting condition indicator moved by said positioning member coming in contact with said mounting condition indicator when said additionally installable apparatus is attached to said main body.

8. The image forming apparatus according to claim 7, wherein a portion of said mounting condition indicator is movable to a position facing to said confirmation window.

9. The image forming apparatus according to claim 7, wherein said mounting condition indicator is secured to said main body at a location other than a location nearest to said confirmation window.

10. The image forming apparatus according to claim 7, wherein said mounting condition indicator has a positioning member penetration portion at a location corresponding to said receiving portion to allow said positioning member to penetrate through said positioning member penetration portion.

11. The image forming apparatus according to claim 8, wherein:

said mounting condition indicator does not cover said confirmation window where said positioning member is not in contact with said mounting condition indicator;

a portion of said mounting condition indicator covers said confirmation window where said positioning member comes in contact with said mounting condition indicator to render the mounting condition indicator in contact with a surface of said main body facing to said additionally installable apparatus; and said portion of said mounting condition indicator withdraws to allow a portion of said confirmation window to be opened where said positioning member engages with said receiving portion.

12. An image forming apparatus comprising:

a main body having an image forming section; and an additionally installable apparatus detachably attached to said main body, the additionally installable apparatus having a positioning member on a surface facing to said main body;

wherein said main body also has a receiving portion disposed on a surface facing to said additionally installable apparatus for receiving said positioning member, and a movable guide member for guiding said positioning member to said receiving portion, the guide member having a protruding portion protruding toward the additionally installable apparatus, and wherein when the positioning member pushes the guide member, the protruding portion of the guide member moves toward said surface of the main body facing to the additionally installable device.

13. The image forming apparatus according to claim 12, wherein said guide member has a shape covering said receiving portion.

14. The image forming apparatus according to claim 12, wherein said guide member has a positioning member penetration portion at a location corresponding to said receiving portion to allow said positioning member to penetrate through said positioning member penetration portion.

15. The image forming apparatus according to claim 12, wherein said guide member is arranged near said receiving portion.

16. The image forming apparatus according to claim 12, wherein said main body has a confirmation window allowing a user to see a mounting state between said main body and said additionally installable apparatus, and wherein said guide member has a securing portion arranged at a location farthest from said confirmation window.

17. The image forming apparatus according to claim 12 wherein:

said guide member has a positioning member penetration portion at a location corresponding to said receiving portion to allow said positioning member penetrate through said positioning member penetration portion, and wherein a portion of said guide member having said positioning member penetration portion is inclined with respect to said surface of said main body facing to said additionally installable apparatus.

18. The image forming apparatus according to claim 14, wherein $d<D<D1$ is satisfied where an outer diameter of said positioning member is d, an inner diameter of said receiving portion is D, and an inner diameter of said positioning member penetration portion of said guide member is D1.

19. The image forming apparatus according to claim 12, wherein said receiving portion is arranged at a location remote from a connector unit electrically connecting said main body with said additionally installable apparatus.

20. The image forming apparatus according to claim 12, further comprising a plurality of said additionally installable apparatuses, and wherein any one of said plurality of additionally installable apparatuses has said receiving portion disposed on said surface facing to another of said plurality of additionally installable apparatuses for receiving said positioning member and said guide portion for guiding said positioning member to said receiving portion, and wherein said guide member is arranged at said position corresponding to said receiving member and is arranged at said prescribed distance from said surface of said main body facing to said additionally installable apparatus.

* * * * *